US007933770B2

(12) United States Patent
Krüger et al.

(10) Patent No.: US 7,933,770 B2
(45) Date of Patent: Apr. 26, 2011

(54) METHOD AND DEVICE FOR CODING AUDIO DATA BASED ON VECTOR QUANTISATION

(75) Inventors: Hauke Krüger, Aachen (DE); Peter Vary, Aachen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 955 days.

(21) Appl. No.: 11/827,778

(22) Filed: Jul. 13, 2007

(65) Prior Publication Data

US 2008/0015852 A1 Jan. 17, 2008

Related U.S. Application Data

(60) Provisional application No. 60/831,092, filed on Jul. 14, 2006.

(51) Int. Cl.
*G10L 19/12* (2006.01)

(52) U.S. Cl. ..... 704/222; 704/219; 704/230

(58) Field of Classification Search ..... 704/219, 704/222, 230
See application file for complete search history.

(56) References Cited

U.S. PATENT DOCUMENTS

| | | | | |
|---|---|---|---|---|
| 5,619,717 | A * | 4/1997 | Staats | 712/36 |
| 5,734,791 | A * | 3/1998 | Acero et al. | 704/222 |
| 6,192,336 | B1 * | 2/2001 | Manduchi et al. | 704/230 |
| 6,836,225 | B2 * | 12/2004 | Lee et al. | 341/50 |
| 2001/0023396 | A1 * | 9/2001 | Gersho et al. | 704/220 |

OTHER PUBLICATIONS

M. Schroeder, B. Atal, "Code-excited linear prediction (CELP): High-quality speech at very low bit rates", Proc. ICASSP'85, pp. 937-940, 1985.

T. Painter, "Perceptual Coding of Digital Audio", Proc. Of IEEE, vol. 88. No. 4, 2000.

European Telecomm. Standards Institute, "Adaptive Multi-Rate (AMR) speech transcoding", ETSI Rec. GSM 06.90 (1998).

ITU-T Rec. G722, "7 kHz audio coding within 64 kbit/s" International Telecommunication Union (1988).

E. Gamal, L. Hemachandra, I. Shperling, V. Wei "Using Simulated Annealing to Design Good Codes", IEEE Trans. Information Theory, vol. it-33, No. 1, 1987.

J. Hamkins, "Design and Analysis of Spherical Codes", PhD Thesis, University of Illinois, 1996.

Jayant, N.S., Noll, P., "Digital Coding of Waveforms", Prentice-Hall, Inc., 1984.

J.-P. Adoul, C. Lamblin, A. Leguyader, "Baseband Speech Coding at 2400 bps using Spherical Vector Quantisation", Proc. ICASSP'84, pp. 45-48, Mar. 1984.

Y. Linde, A. Buzo, R.M.Gray, "An Algorithm for Vector Quantizer Design", IEEE Trans. Communications, 28 (1):84-95, Jan. 1980.

* cited by examiner

*Primary Examiner* — Abul Azad

(57) ABSTRACT

A wideband audio coding concept is presented that provides good audio quality at bit rates below 3 bits per sample with an algorithmic delay of less than 10 ms. The concept is based on the principle of Linear Predictive Coding (LPC) in an analysis-by-synthesis framework. A spherical codebook is used for quantisation at bit rates which are higher in comparison to low bit rate speech coding for improved performance for audio signals. For superior audio quality, noise shaping is employed to mask the coding noise. In order to reduce the computational complexity of the encoder, the analysis-by synthesis framework has been adapted for the spherical codebook to enable a very efficient excitation vector search procedure. Furthermore, auxiliary information gathered in advance is employed to reduce a computational encoding and decoding complexity at run time significantly. This auxiliary information can be considered as the SCELP codebook. Due to the consideration of the characteristics of the apple-peeling-code construction principle, this codebook can be stored very efficiently in a read-only-memory.

20 Claims, 4 Drawing Sheets

METHOD AND DEVICE FOR CODING AUDIO DATA BASED ON VECTOR QUANTISATION

CROSS REFERENCE TO RELATED APPLICATIONS

The present application claims the benefit of the provisional patent application filed on Jul. 14, 2006, and assigned application Ser. No. 60/831,092, and is incorporated by reference herein in its entirety.

FIELD OF INVENTION

The present invention relates to a method and device for encoding audio data on the basis of linear prediction combined with vector quantisation based on a gain-shape vector codebook. Moreover, the present invention relates to a method for communicating audio data and respective devices for encoding and communicating. Specifically, the present invention relates to microphones and hearing aids employing such methods and devices.

BACKGROUND OF INVENTION

Methods for processing audio signals are for example known from the following documents, to which reference will be made to in this document and which are incorporated by reference herein in their entirety:

[1] M. Schroeder, B. Atal, "Code-excited linear prediction (CELP): High -quality speech at very low bit rates", Proc. ICASSP'85, pp. 937-940, 1985.

[2] T. Painter, "Perceptual Coding of Digital Audio", Proc. Of IEEE, vol. 88. no. 4, 2000.

[3] European Telecomm. Standards Institute, "Adaptive Multi-Rate (AMR) speech transcoding" ETSI Rec. GSM 06.90 (1998).

SUMMARY OF INVENTION

It is an object of the present invention to provide a method and a device for encoding and communicating audio data having low delay and complexity of the respective algorithms.

According to the present invention the above object is solved by a method for encoding audio data on the basis of linear prediction combined with vector quantisation based on a gain-shape vector codebook, providing an audio input vector to be encoded, preselecting a group of code vectors of said codebook by selecting code vectors in the vicinity of the input vector, and encoding the input vector with a code vector of said group of code vectors having the lowest quantisation error within said group of preselected code vectors with respect to the input vector.

Furthermore, there is provided a device for encoding audio data on the basis of linear prediction combined with vector quantisation based on a gain-shape vector codebook, comprising:

audio vector means for providing an audio input vector to be encoded, preselecting means for preselecting a group of code vectors of said codebook by selecting code vectors in the vicinity of the input vector received from said audio vector means and encoding means connected to said preselecting means for encoding the input vector from said audio vector means with a code vector of said group of code vectors having the lowest quantisation error within said group of preselected code vectors with respect to the input vector.

Preferably, the input vector is located between two quantisation values of each dimension of the code vector space and each vector of the group of preselected code vectors has a coordinate corresponding to one of the two quantisation values. Thus, the audio input vector always has two neighbors of code vectors for each dimension, so that the group of code vectors is clearly limited.

Furthermore, the quantisation error for each preselected code vector of a pregiven quantisation value of one dimension may be calculated on the basis of partial distortion of said quantisation value, wherein a partial distortion is calculated once for all code vectors of the pregiven quantisation value. The advantage of this feature is that the partial distortion value calculated in one level of the algorithm can also be used in other levels of the algorithm.

According to a further preferred embodiment partial distortions are calculated for quantisation values of one dimension of the preselected code vectors, and a subgroup of code vectors is excluded from the group of preselected code vectors, wherein the partial distortion of the code vectors of the subgroup is higher than the partial distortion of other code vectors of the group of preselected code vectors. Such exclusion of candidates for code vectors reduces the complexity of the algorithm.

Moreover, the code vectors may be obtained by an apple-peeling-method, wherein each code vector is represented as branch of a code tree linked with a table of trigonometric function values, the code tree and the table being stored in a memory so that each code vector used for encoding the audio data is reconstructable on the basis of the code tree and the table. Thus, an efficient codebook for SCELP (Spherical Code Exited Linear Prediction) low delay audio codec is provided.

The above described encoding principle may advantageously be used for a method for communicating audio data by generating said audio data in a first audio device, encoding the audio data in the first audio device, transmitting the encoded audio data from the first audio device to a second audio device, and decoding the encoded audio data in the second audio device. If an apple-peeling-method is used together with the above described code tree and table of trigonometric function values, an index unambiguously representing a code vector may be assigned to the code vector selected for encoding. Subsequently, the index is transmitted from the first audio device to the second audio device and the second audio device uses the same code tree and table for reconstructing the code vector and decodes the transmitted data with the reconstructed code vector. Thus, the complexity of encoding and decoding is reduced and the transmission of the code vector is minimized to the transmission of an index only.

Furthermore, there is provided an audio system comprising a first and a second audio device, the first audio device including a device for encoding audio data according to the above described method and also transmitting means for transmitting the encoded audio data to the second audio device, wherein the second audio device includes decoding means for decoding the encoded audio data received from the first audio device.

The above described methods and devices are preferably employed for the wireless transmission of audio signals between a microphone and a receiving device or a communication between hearing aids. However, the present application is not limited to such use only. The described methods and devices can rather be utilized in connection with other audio devices like headsets, headphones, wireless microphones and so on.

Furthermore a lossy compression of audio signals can be roughly subdivided into two principles: Perceptual audio coding is based on transform coding: The signal to be compressed is firstly transformed by an analysis filter bank, and the sub band representation is quantized in the transform domain. A perceptual model controls the adaptive bit allocation for the quantisation. The goal is to keep the noise introduced by quantisation below the masking threshold described by the perceptual model. In general, the algorithmic delay is rather high due to large transform lengths, e.g. [2]. Parametric audio coding is based on a source model. In this document it is focused on the linear prediction (LP) approach, the basis for todays highly efficient speech coding algorithms for mobile communications, e.g. [3]: An all -pole filter models the spectral envelope of an input signal. Based on the inverse of this filter, the input is filtered to form the LP residual signal which is quantized. Often vector quantisation with a sparse codebook is applied according to the CELP (Code Excited Linear Prediction, [1]) approach to achieve very high bit rate compression. Due to the sparse codebook and additional modeling of the speakers instantaneous pitch period, speech coders perform well for speech but cannot compete with perceptual audio coding for non-speech input. The typical algorithmic delay is around 20 ms. In this document the ITU-T G.722 is chosen as a reference codec for performance evaluations. It is a linear predictive wideband audio codec, standardized for a sample rate of 16 kHz. The ITU-T G.722 relies on a sub band (SB) decomposition of the input and an adaptive scalar quantisation according to the principle of adaptive differential pulse code modulation for each sub band (SB-ADPCM). The lowest achievable bit rate is 48 kbit/sec (mode 3). The SB-ADPCM tends to become instable for quantisation with less than 3 bits per sample.

In the following reference will be made also to the following documents which are incorporated by reference herein in their entirety:

[4] ITU-T Rec. G722, "7 kHz audio coding within 64 kbit/s" International Telecommunication Union (1988).

[5] E. Gamal, L. Hemachandra, I. Shperling, V. Wei "Using Simulated Annealing to Design Good Codes", IEEE Trans. Information Theory, Vol. it-33, no. 1, 1987.

[6] J. Hamkins, "Design and Analysis of Spherical Codes", PhD Thesis, University of Illinois, 1996.

[7] J. B. Huber, B. Matschkal, "Spherical Logarithmic Quantisation and its Application for DPCM", 5th Intern. ITG Conf.

on Source and Channel Coding, pp. 349-356, Erlangen, Germany, 2004.

[8] Jayant, N. S., Noll, P., "Digital Coding of Waveforms", Prentice-Hall, Inc., 1984.

[9] K. Paliwal, B. Atal, "Efficient Vector Quantisation of LPC Parameters at 24 Bits/Frame", IEEE Trans. Speech and Signal Proc., vol. 1, no. 1, pp. 3-13, 1993.

[10] J.-P. Adoul, C. Lamblin, A. Leguyader, "Baseband Speech Coding at 2400 bps using Spherical Vector Quantisation", Proc. ICASSP'84, pp. 45 - 48, March 1984.

[11] Y. Linde, A. Buzo, R. M. Gray, "An Algorithm for Vector Quantizer Design", IEEE Trans. Communications, 28(1): 84-95, Jan. 1980.

BRIEF DESCRIPTION OF THE DRAWINGS

The present invention is explained in more detail by means of drawings showing in.

DETAILED DESCRIPTION OF INVENTION

Figure 1:
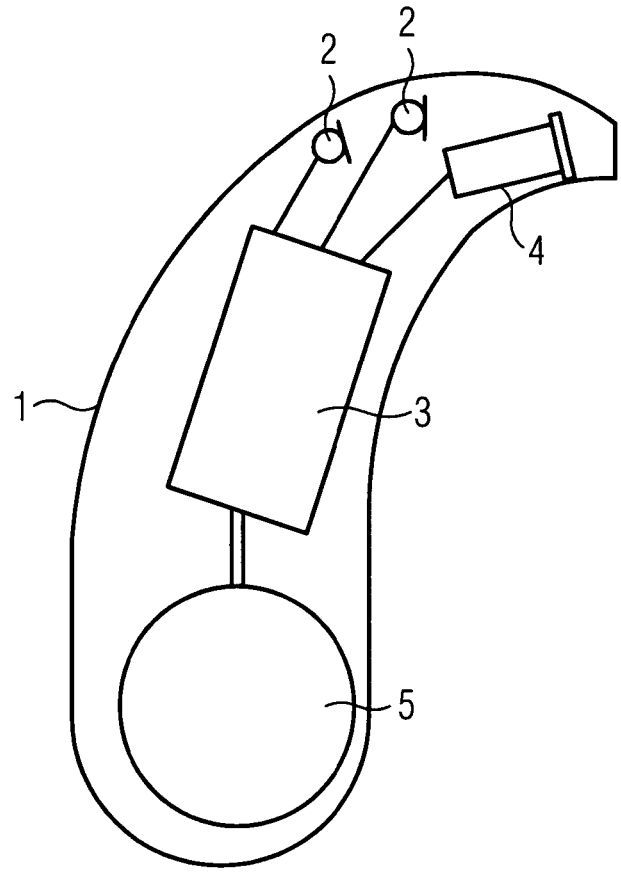
FIG. 1 the principle structure of a hearing aid.

Since the present application is preferably applicable to hearing aids, such devices shall be briefly introduced in the next two paragraphs together with FIG. 1.

Hearing aids are wearable hearing devices used for supplying hearing impaired persons. In order to comply with the numerous individual needs, different types of hearing aids, like behind-the-ear-hearing aids (BTE) and in-the-ear-hearing aids (ITE), e.g. concha hearing aids or hearing aids completely in the canal (CIC), are provided. The hearing aids listed above as examples are worn at or behind the external ear or within the auditory canal. Furthermore, the market also provides bone conduction hearing aids, implantable or vibrotactile hearing aids. In these cases the affected hearing is stimulated either mechanically or electrically.

In principle, hearing aids have an input transducer, an amplifier and an output transducer as essential component. The input transducer usually is an acoustic receiver, e.g. a microphone, and/or an electromagnetic receiver, e.g. an induction coil. The output transducer normally is an electroacoustic transducer like a miniature speaker or an electromechanical transducer like a bone conduction transducer. The amplifier usually is integrated into a signal processing unit. Such principle structure is shown in FIG. 1 for the example of an BTE hearing aid. One or more microphones 2 for receiving sound from the surroundings are installed in a hearing aid housing 1 for wearing behind the ear. A signal processing unit 3 being also installed in the hearing aid housing 1 processes and amplifies the signals from the microphone. The output signal of the signal processing unit 3 is transmitted to a receiver 4 for outputting an acoustical signal. Optionally, the sound will be transmitted to the ear drum of the hearing aid user via a sound tube fixed with a otoplasty in the auditory canal. The hearing aid and specifically the signal processing unit 3 are supplied with electrical power by a battery 5 also installed in the hearing aid housing 1.

Figure 2:
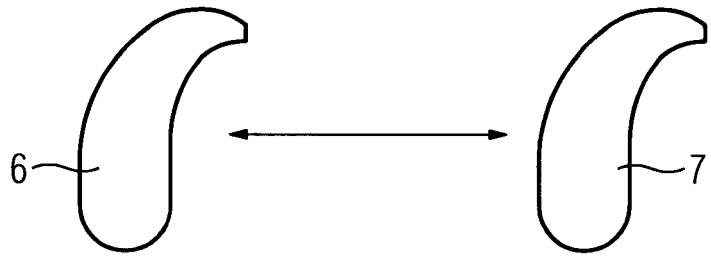
FIG. 2 a first audio system including two communicating hearing aids.

In case the hearing impaired person is supplied with two hearing aids, a left one and a right one, audio signals may have to be transmitted from the left hearing aid 6 to the right hearing aid 7 or vice versa as indicated in FIG. 2. For this purpose the inventive wide band audio coding concept described below can be employed.

Figure 3:
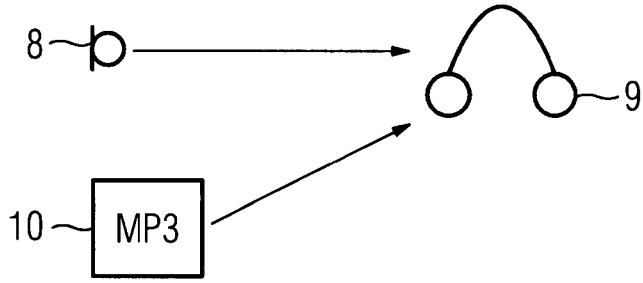
FIG. 3. a second audio system including a headphone or earphone receiving signals from a microphone or another audio device.

This audio coding concept can also be used for other audio devices as shown in FIG. 3. For example the signal of an external microphone 8 has to be transmitted to a headphone or earphone 9. Furthermore, the inventive coding concept may be used for any other audio transmission between audio devices like a TV-set or an MP3-player 10 and earphones 9 as also depicted in FIG. 3. Each of the devices 6 to 10 comprises encoding, transmitting and decoding means as far as the communication demands. The devices may also include audio vector means for providing an audio input vector from an input signal and preselecting means, the function of which is described below.

In the following this new coding scheme for low delay audio coding is introduced in detail. In this codec, the principle of linear prediction is preserved while a spherical codebook is used in a gain-shape manner for the quantisation of the residual signal at a moderate bit rate. The spherical codebook is based on the apple-peeling code introduced in [5] for the purpose of channel coding and referenced in [6] in the context of source coding. The apple -peeling code has been revisited in [7]. While in that approach, scalar quantisation is applied in polar coordinates for DPCM, in the present document the spherical code in the context of vector quantisation in a CELP like scheme is considered. The principle of linear predictive coding will be shortly explained in Section 1. After that, the construction of the spherical code according to the apple-peeling method is described in Section 2. In Section 3, the analysis-by-synthesis framework for linear predictive vector quantisation will be modified for the demands of the spherical codebook. Based on the proposed structure, a computationally efficient search procedure with pre-selection and candidate-exclusion is presented. Results of the specific vector quantisation are shown in Section 4 in terms of a comparison with the G.722 audio codec. In Section 5 it is proposed to use auxiliary information which can be determined in advance during code construction. This auxiliary information is stored in read-only-memory (ROM) and can be considered as a compact vector codebook. At codec runtime it aids the process of transforming the spherical code vector index, used for signal transmission, into the reconstructed code vectors on encoder and decoder side. The compact codebook is based on a representation of the spherical code as a coding tree combined with a lookup table to store all required trigonometric function values for spherical coordinate transformation. Because both parts of this compact codebook are determined in advance the computational complexity for signal compression can be drastically reduced. The properties of the compact codebook can be exploited to store it with only a small demand for ROM compared to an approach that stores a lookup table as often applied for trained codebooks [11]. A representation of spherical apple-peeling code as spherical coding tree for code vector decoding is explained in Section 5.1. In Section 5.2, the principle to efficiently store the coding tree and the lookup table for trigonometric function values for code vector reconstruction is presented. Results considering the reduction of the computational and memory complexity are given in Section 5.3.

1. Block Adaptive Linear Prediction

The principle of linear predictive coding is to exploit correlation immanent to an input signal x(k) by decorrelating it before quantisation. For short term block adaptive linear prediction, a windowed segment of the input signal of length $L_{LPC}$ is analyzed in order to obtain time variant filter coefficients $a_1 \ldots a_N$ of order N. Based on these filter coefficients the input signal is filtered with $$H_A(z) = 1 - \sum_{i=1}^{N} a_i \cdot z^{-i}$$

the LP (linear prediction) analysis filter, to form the LP residual signal d(k). d(k) is quantized and transmitted to the decoder as $\tilde{d}(k)$. The LP synthesis filter $H_S(z)=(H_A(z))^{-1}$ reconstructs from $\tilde{d}(k)$ the signal $\tilde{x}(k)$ by filtering (all-pole filter) in the decoder. Numerous contributions have been published concerning the principles of linear prediction, for example [8].

In the context of block adaptive linear predictive coding, the linear prediction coefficients must be transmitted in addition to signal $\tilde{d}(k)$. This can be achieved with only small additional bit rate as shown for example in [9]. The length of the signal segment used for LP analysis, $L_{LPC}$, is responsible for the algorithmic delay of the complete codec.

Closed Loop Quantisation

Figure 4:
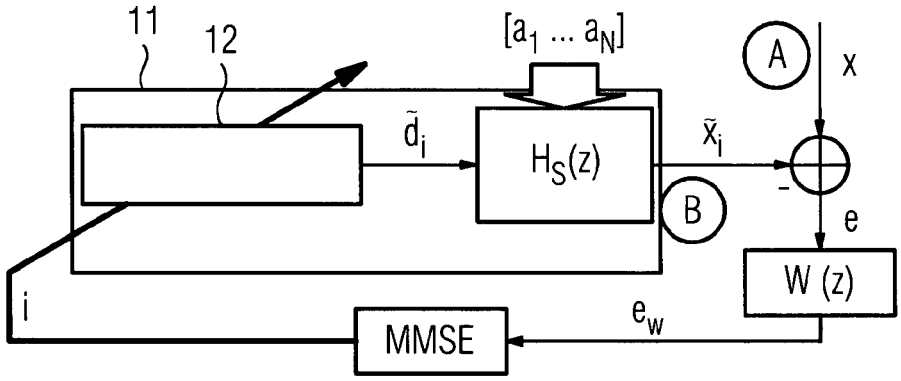
FIG. 4 a block diagram of the principle of analysis-by-synthesis for vector quantisation.

A linear predictive closed loop scheme can be easily applied for scalar quantisation (SQ). In this case, the quantizer is part of the linear prediction loop, therefore also called quantisation in the loop. Compared to straight pulse code modulation (PCM) closed loop quantisation allows to increase the signal to quantisation noise ratio (SNR) according to the achievable prediction gain immanent to the input signal. Considering vector quantisation (VQ) multiple samples of the LP residual signal d(k) are combined in a vector $d=[d_0 \ldots d_{L_V-1}]$ of length $L_V$ in chronological order with $l=0 \ldots (L_V-1)$ as vector index prior to quantisation in $L_V$-dimensional coding space. Vector quantisation can provide significant benefits compared to scalar quantisation. For closed loop VQ the principle of analysis-by-synthesis is applied at the encoder side to find the optimal quantized excitation vector $\tilde{d}$ for the LP residual, as depicted in FIG. 4. For analysis-by-synthesis, the decoder 11 is part of the encoder. For each index i corresponding to one entry in a codebook 12, an excitation vector $\tilde{d}_i$ is generated first. That excitation vector is then fed into the LP synthesis filter $H_S(z)$. The resulting signal vector $\tilde{x}_i$ is compared to the input signal vector x to find the index $i_Q$ with minimum mean square error (MMSE)

$$i_Q = \underset{i}{\operatorname{argmin}}\{\mathcal{D}_i = (x - \hat{x}_i) \cdot (x - \hat{x}_i)^T\} \tag{1}$$

By the application of an error weighting filter W(z), the spectral shape of the quantisation noise inherent to the decoded signal can be controlled for perceptual masking of the quantisation noise.

W(z) is based on the short term LP coefficients and therefore adapts to the input signal for perceptual masking similar to that in perceptual audio coding, e.g. [1]. The analysis-by-synthesis principle can be exhaustive in terms of computational complexity due to a large vector codebook.

2. Spherical Vector Codebook

Spherical quantisation has been investigated intensively, for example in [6], [7] and [10]. The codebook for the quantisation of the LP residual vector $\tilde{d}$ consists of vectors that are composed of a gain (scalar) and a shape (vector) component. The code vectors $\tilde{c}$ for the quantisation of the shape component are located on the surface of a unit sphere. The gain component is the quantized radius $\tilde{R}$. Both components are combined to determine $$\tilde{d}=\tilde{R}\cdot\tilde{c} \tag{2}$$

For transmission, the codebook index $i_{sp}$ and the index $i_R$ for the reconstruction of the shape part of the vector and the gain factor respectively must be combined to form codeword $i_Q$. In this section the design of the spherical codebook is shortly described first. Afterwards, the combination of the indices for the gain and the shape component is explained. For the proposed codec a code construction rule named apple-peeling due to its analogy to peeling an apple in three dimensions is used to find the spherical codebook $\mathscr{C}$ in the $L_V$-dimensional coding space. Due to the block adaptive linear prediction, $L_V$ and $L_{LPC}$ are chosen so that $$N_V = L_{LPC}/L_V \in \mathbb{Z}.$$

The concept of the construction rule is to obtain a minimum angular separation θ between codebook vectors on the surface of the unit sphere (centroids: $\tilde{c}$) in all directions and thus to approximate a uniform distribution of all centroids on the surface as good as possible. As all available centroids, $\tilde{c} \in \mathscr{C}$ have unit length, they can be represented in ($L_V$-1) angles $[\tilde{\phi}_0 \ldots \tilde{\phi}_{L_V-2}]$.

Figure 5:
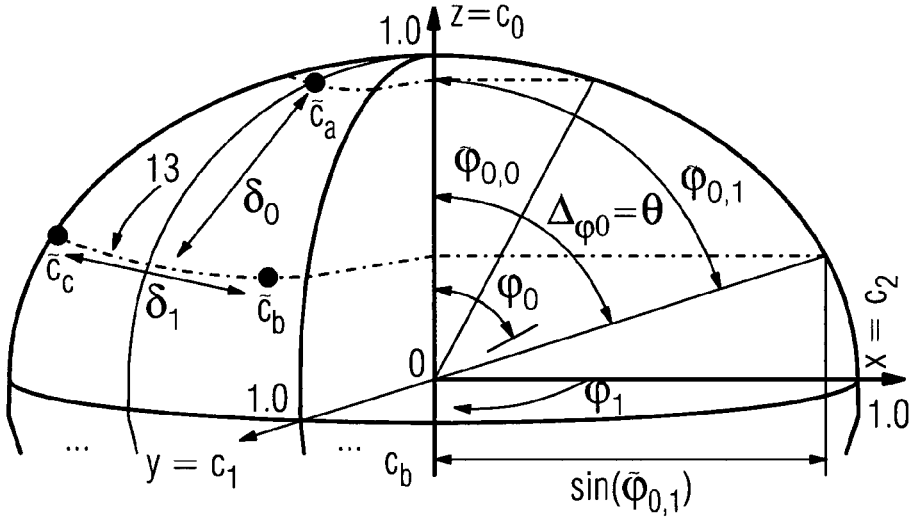
FIG. 5 a 3-dimensional sphere for an apple-peeling-code.

Due to the reference to existing literature, the principle will be demonstrated here by an example of a 3-dimensional sphere only, as depicted in FIG. 5. There, the example centroids according to the apple-peeling algorithm, $\tilde{c}_a \ldots \tilde{c}_c$, are marked as big black spots on the surface.

The sphere has been cut in order to display the 2 angles, $\phi_0$ in x-z-plane and $\phi_1$ in x-y-plane. Due to the symmetry properties of the vector codebook, only the upper half of the sphere is shown. For code construction, the angles will be considered in the order of $$\phi_0 \text{ to } \phi_1,\ 0 \leqq \phi_0 < \pi \text{ and } 0 \leqq \phi_1 < 2\pi$$

for the complete sphere. The construction constraint to have a minimum separation angle θ in between neighbor centroids can be expressed also on the surface of the sphere: The distances between neighbor centroids in one direction is noted as $\delta_0$ and $\delta_1$ in the other direction. As the centroids are placed on a unit sphere and for small θ, the distances can be approximated by the circular arc according to the angle θ to specify the apple-peeling constraint:

$$\delta_0 \geqq \theta,\ \delta_1 \geqq \theta \text{ and } \delta_0 \approx \delta_1 \approx \theta \tag{3}$$

The construction parameter Θ is chosen as $\Theta(N_{sp}) = \pi/N_{sp}$ with the new construction parameter $$N_{sp} \in \mathbb{Z}^+$$

for codebook generation. By choosing the number of angles $N_{SP}$, the range of angle $\phi_0$ is divided into $N_{SP}$ angle intervals with equal size of $$\Delta_{\phi_0} = \theta(N_{SP}).$$

Circles (slash-dotted line 13 for $\tilde{\phi}_{0,1}$ in FIG. 5) on the surface of the unit sphere at $$\phi_0 = \tilde{\phi}_{0,i_0} = (i_0 + 1/2) \cdot \Delta_{\phi_0} \tag{4}$$

are linked to index $i_0 = 0 \ldots (N_{SP}-1)$. The centroids of the apple -peeling code are constrained to be located on these circles which are spaced according to the distance $\delta_0$, hence $$\phi_0 \in \tilde{\phi}_{0,i_0} \text{ and } \tilde{z} = \cos(\tilde{\phi}_{0,i_0})$$

in cartesian coordinates for all $\tilde{c} \in \mathscr{C}$ The radius of each circle depends on $\tilde{\phi}_{0,i0}$. The range of $\phi_1$, $0 \leqq \phi_1 < 2\pi$, is divided into $N_{SP,1}$ angle intervals of equal length $\Delta_{\phi 1}$. In order to hold the minimum angle constraint, the separation angle $\Delta_{\phi 1}$ is different from circle to circle and depends on the circle radius and thus $\tilde{\phi}_{0,i0}$ $$\Delta_{\varphi_1}(\tilde{\varphi}_{0,i_0}) = \frac{2\pi}{N_{sp,1}(\tilde{\varphi}_{0,i_0})} \geq \frac{\theta(N_{sp})}{\sin(\tilde{\varphi}_{0,i_0})}. \tag{5}$$

With this, the number of intervals for each circle is $$N_{sp,1}(\tilde{\varphi}_{0,i_0}) = \left\lfloor \frac{2\pi}{\theta(N_{sp})} \cdot \sin(\tilde{\varphi}_{0,i_0}) \right\rfloor \tag{6}$$

In order to place the centroids onto the sphere surface, the according angles $\tilde{\phi}_{1,i1}(\tilde{\phi}_{0,i0})$ associated with the circle for $\tilde{\phi}_{0,i0}$ are placed in analogy to (4) at positions $$\tilde{\varphi}_{1,i_1}(\tilde{\varphi}_{0,i_0}) = (i_1 + 1/2) \cdot \frac{2\pi}{N_{sp,1}(\tilde{\varphi}_{0,i_0})} \tag{7}$$

Each tuple $[i_0, i_1]$ identifies the two angles and thus the position of one centroid of the resulting code $\mathscr{C}$ for starting parameter $N_{SP}$.

For an efficient vector search described in the following section, with the construction of the sphere in the order of angles $\tilde{\phi}_0 \rightarrow \tilde{\phi}_1 \ldots \tilde{\phi}_{LV-2}$, the coordinates of the sphere vector in cartesian must be constructed in chronological order, $\tilde{c}_0 \rightarrow \tilde{c}_1 \ldots \tilde{c}_{LV-1}$. As with angle $\tilde{\phi}_0$ solely the cartesian coordinate in z-direction can be reconstructed, the z-axis must be associated to $c_0$, the y-axis to $c_1$ and the x-axis to $c_2$ in FIG. 5. Each centroid described by the tuple of $[i_0, i_1]$ is linked to a sphere index $$i_{sp} = 0 \ldots (M_{sp}(N_{sp}) - 1)$$

with the number of centroids $M_{sp}(N_{sp})$ as a function of the start parameter $N_{sp}$. For centroid reconstruction, an index can easily be transformed into the corresponding angles $$\tilde{\phi}_0 \rightarrow \tilde{\phi}_1 \ldots \tilde{\phi}_{LV-2}$$

by sphere construction on the decoder side. For this purpose and with regard to a low computational complexity, an auxiliary codebook based on a coding tree can be used. The centroid cartesian coordinates $c_l$ with vector index l are $$\tilde{c}_l = \begin{cases} \cos(\tilde{\varphi}_l) \cdot \prod_{j=0}^{(l-1)} \sin(\tilde{\varphi}_j); & 0 \leq l < (L_V - 1) \\ \prod_{j=0}^{(L_V-2)} \sin(\tilde{\varphi}_j); & l = (L_V - 1) \end{cases}. \tag{8}$$

To retain the required computational complexity as low as possible, all computations of trigonometric functions for centroid reconstruction in Equation (8), $\sin(\tilde{\phi}_{l/i})$ and $\cos(\tilde{\phi}_{l/i})$, can be computed and stored in small tables in advance.

For the reconstruction of the LP residual vector $\tilde{d}$, the centroid $\tilde{c}$ must be combined with the quantized radius $\tilde{R}$ according to (2). With respect to the complete codeword $i_Q$ for a signal vector of length $L_V$, a budget of $r = r_0 * L_V$ bits is available with $r_0$ as the effective number of bits available for each sample. Considering available $M_R$ indices $i_R$ for the reconstruction of the radius and $M_{sp}$ indices $i_{sp}$ for the reconstruction of the vector on the surface of the sphere, the indices can be combined in a codeword $i_Q$ as $$i_Q = i_R \cdot M_{sp} + i_{sp} \tag{9}$$

for the sake of coding efficiency. In order to combine all possible indices in one codeword, the condition $$2^r \geqq M_{sp} \cdot M_R \tag{10}$$

must be fulfilled.

A possible distribution of $M_R$ and $M_{sp}$ is proposed in [7]. The underlying principle is to find a bit allocation such that the distance $\Theta(N_{sp})$ between codebook vectors on the surface of the unit sphere is as large as the relative step size of the logarithmic quantisation of the radius. In order to find the combination of $M_R$ and $M_{sp}$ that provides the best quantisation performance at the target bit rate r, codebooks are designed iteratively to provide the highest number of index combinations that still fulfill constraint (10).

3. Optimized Excitation Search

Figure 6:
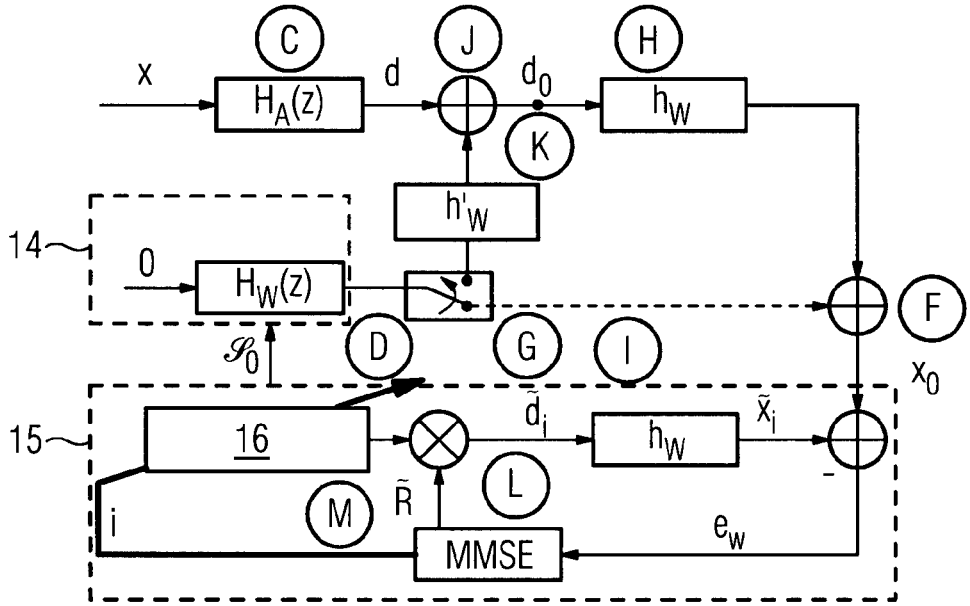
FIG. 6 a block diagram of a modified analysis-by-synthesis.

Among the available code vectors constructed with the applepeeling method the one with the lowest (weighted) distortion according to Equation (1) must be found applying analysis-by-synthesis as depicted in FIG. 4. This can be exhaustive for the large number of available code vectors that must be filtered by the LP synthesis filter to obtain $\tilde{x}$. For the purpose of complexity reduction, the scheme in FIG. 4 is modified as depicted in FIG. 6. Positions are marked in both Figures with capital letters A and B in FIG. 4 and C to M in FIG. 6 to explain the modifications. The proposed scheme is applied for the search of adjacent signal segments of length $L_V$. For the modification, the filter W(z) is moved into the signal paths marked as A and B in FIG. 4. The LP synthesis filter is combined with W(z) to form the recursive weighted synthesis filter $$H_W(z)=H_S(z)\cdot W(z)$$

in signal path B. In signal branch A, W(z) is replaced by the cascade of the LP analysis filter and the weighted LP synthesis filter $H_W(z)$:

$$W(z)=H_A(z)\cdot H_S(z)\cdot W(z)=H_A(z)\cdot H_W(z) \tag{11}$$

The newly introduced LP analysis filter in branch A in FIG. 4 is depicted in FIG. 6 at position C. The weighted synthesis filter $H_W(z)$ in the modified branches A and B have identical coefficients. These filters, however, hold different internal states: $\mathscr{S}$ according to the history of d(k) in modified signal branch A and $\tilde{\mathscr{S}}$ according to the history of $\tilde{d}(k)$ in modified branch B. The filter ringing signal (filter ringing 14) due to the states will be considered separately: As $H_W(z)$ is linear and time invariant (for the length of one signal vector), the filter ringing output can be found by feeding in a zero vector 0 of length $L_V$. For paths A and B the states are combined as $\mathscr{S}_0 = \mathscr{S} - \tilde{\mathscr{S}}$ in one filter and the output is considered at position D in FIG. 6. The corresponding signal is added at position F if the switch at position G is chosen accordingly. With this, $H_W(z)$ in the modified signal paths A and B can be treated under the condition that the states are zero, and filtering is transformed into a convolution with the truncated impulse response of filter $H_W(z)$ as shown at positions H and I in FIG. 6.

$$h_W=[h_{W,0} \ldots h_{W,(L_V-1)}],\ h_W(k) \circ\!\!-\!\!\bullet H_W(z) \tag{12}$$

The filter ringing signal at position F can be equivalently introduced at position J by setting the switch at position G in FIG. 6 into the corresponding other position. It must be convolved with the truncated impulse response $h'_W$ of the inverse of the weighted synthesis filter, $h'_W(k) \circ\!\!-\!\!\bullet (H_W(z))^{-1}$, in this case. Signal $d_0$ at position K is considered to be the starting point for the pre-selection described in the following:

3.1 Complexity Reduction based on Pre-selection

Figure 7:
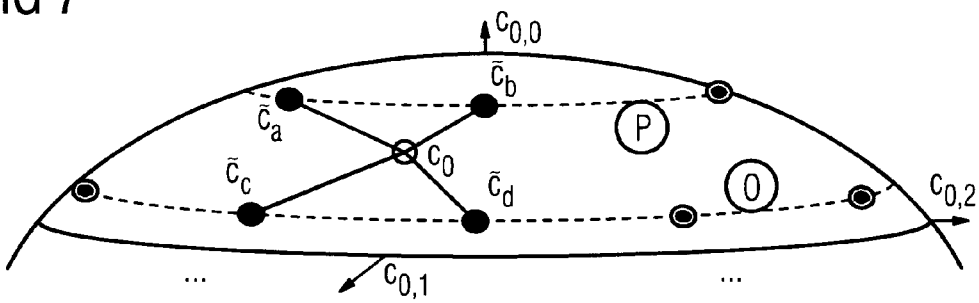
FIG. 7 neighbor centroides due to pre-search.

Based on $d_0$ the quantized radius, $\tilde{R}=Q(\|d_0\|)$, is determined first by means of scalar quantisation Q and used at position M. Neighbor centroids on the unit sphere surface surrounding the unquantized signal after normalization ($c_0=d_0/\|d_0\|$) are pre-selected in the next step to limit the number of code vectors considered in the search loop 15. FIG. 7 demonstrates the result of the pre-selection in the 3-dimensional case: The apple-peeling centroids are shown as big spots on the surface while the vector $c_0$ as the normalized input vector to be quantized is marked with a cross. The pre-selected neighbor centroids are black in color while all gray centroids will not be considered in the search loop 15. The pre-selection can be considered as a construction of a small group of candidate code vectors among the vectors in the codebook 16 on a sample by sample basis. For the construction a representation of $c_0$ in angles is considered: Starting with the first unquantized normalized sample, $c_{0,1}=0$, the angle $\phi_0$ of the unquantized signal can be determined, e.g. $\phi_0=\arccos(c_{0,0})$. Among the discrete possible values for $\tilde{\phi}_0$ (defined by the apple-peeling principle, Eq. (4)), the lower $\tilde{\phi}_{0,lo}$ and upper $\phi_{0,up}$ neighbor can be determined by rounding up and down. In the example for 3 dimensions, the circles O and P are associated to these angles.

Considering the pre-selection for angle $\phi_1$, on the circle associated to $\tilde{\phi}_{0,lo}$ one pair of upper and lower neighbors, $\tilde{\phi}_{1,lo/up}(\tilde{\phi}_{0,lo})$, and on the circle associated to $\tilde{\phi}_{0,up}$ another pair of upper and lower neighbors, $\tilde{\phi}_{1,lo/up}(\tilde{\phi}_{0,up})$, are determined by rounding up and down. In FIG. 7, the code vectors on each of the circles surrounding the unquantized normalized input are depicted as $\tilde{c}_a$, $\tilde{c}_b$ and $\tilde{c}_c$, $\tilde{c}_d$ in 3 dimensions.

Figure 8:
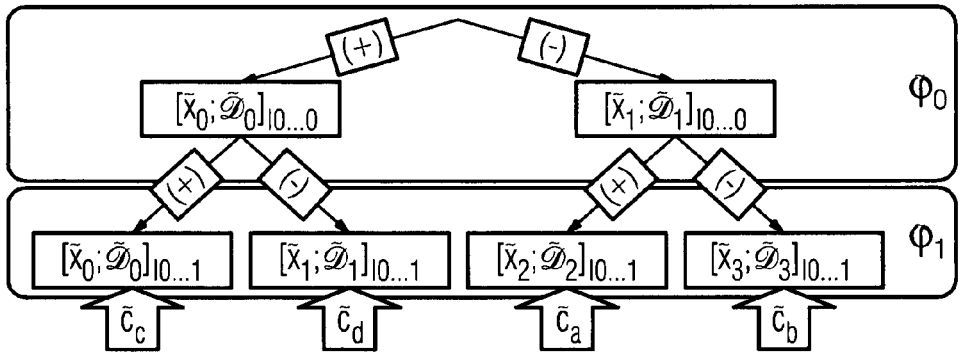
FIG. 8 a binary tree representing pre-selection.

From sample to sample, the number of combinations of upper and lower neighbors for code vector construction increases by a factor of 2. The pre-selection can hence be represented as a binary code vector construction tree, as depicted in FIG. 8 for 3 dimensions. The pre-selected centroids known from FIG. 7 each correspond to one path through the tree. For vector length $L_V$, $2^{(L_V-1)}$ code vectors are pre-selected.

For each pre-selected code vector $\tilde{c}_i$, labeled with index i, signal $\tilde{x}_i$ must be determined as $$\tilde{x}_i=\tilde{d}_i \star h_W=(\tilde{R}\cdot\tilde{c}_i)\star h_W. \tag{13}$$

Using a matrix representation $$H_{w,w} = \begin{bmatrix} h_{w,0} & h_{w,1} & \ldots & h_{w,(L_V-1)} \\ 0 & h_{w,0} & \ldots & h_{w,(L_V-2)} \\ \ldots & \ldots & \ldots & \ldots \\ 0 & 0 & \ldots & h_{w,0} \end{bmatrix} \tag{14}$$

for the convolution, Equation (13) can be written as $$\tilde{x}_i=(\tilde{R}\cdot\tilde{c}_i)\cdot H_{W,W} \tag{15}$$

The code vector $\tilde{c}_i$ is decomposed sample by sample:

$$\begin{aligned} \tilde{c}_i = {} & [\,\tilde{c}_{i,0}\ \ 0\ \ 0\ \ \ldots\ \ 0\,] + \\ & [\,0\ \ \tilde{c}_{i,1}\ \ 0\ \ \ldots\ \ 0\,] + \\ & \ldots + \\ & [\,0\ \ 0\ \ 0\ \ \ldots\ \ \tilde{c}_{i,(L_V-1)}\,] \\ = {} & \tilde{c}_{i,0} + \tilde{c}_{i,1} + \ldots + \tilde{c}_{i,(L_V-1)} \end{aligned} \tag{16}$$

With regard to each decomposed code vector $\tilde{c}_{i,l}$, signal vector $\tilde{x}_i$ can be represented as a superpostion of the corresponding partial convolution output vectors $\tilde{x}_{i,l}$:

$$\tilde{x}_i = \sum_{j=0}^{L_V-1} \hat{x}_{i,j} = \sum_{j=0}^{L_V-1} (\tilde{c}_{i,j} \cdot H_{w,w}). \tag{17}$$

The vector $$\tilde{x}_i\,|_{[0\ldots l_0]} = \sum_{j=0}^{l_0} \tilde{x}_{i,j} \tag{18}$$

is defined as the superposed convolution output vector for the first $(l_0+1)$ coordinates of the code vector $$\tilde{c}_i\,|_{[0\ldots l_0]} = \sum_{j=0}^{l_0} \tilde{c}_{i,j}. \tag{19}$$

Considering the characteristics of matrix $H_{W,W}$ with the first $(l_0+1)$ coordinates of the codebook vector $\tilde{c}_i$ given, the first $(l_0+1)$ coordinates of the signal vector $\tilde{x}_i$ are equal to the first $(l_0+1)$ coordinates of the superposed convolution output vector $\tilde{x}_i|[0\ .\ .\ .\ l_0]$. We therefore introduce the partial (weighted) distortion $$\mathcal{D}_i\Big|_{[0\ldots l_0]} = \sum_{j=0}^{l_0} (x_{0,j} - \tilde{x}_{i,j}\,|_{[0\ldots l_0]})^2. \tag{20}$$

For $(l_0+1)=L_V$, $\mathcal{D}_i|[0\ .\ .\ .\ l_0]$ is identical to the (weighted) distortion $\mathcal{D}_i$(Equation 1) that is to be minimized in the search loop. With definitions (18) and (20), the pre-selection and the search loop to find the code vector with the minimal quantisation distortion can be efficiently executed in parallel on a sample by sample basis: We therefore consider the binary code construction tree in FIG. 8: For angle $\tilde{\phi}_0$, the two neighbor angles have been determined in the preselection. The corresponding first Cartesian code vector coordinates $\tilde{c}_i(0),0$ for lower (−) and upper (+) neighbor are combined with the quantized radius $\tilde{R}$ to determine the superposed convolution output vectors and the partial distortion as $$\tilde{x}_i^{(0)}|_{[0\ .\ .\ .\ 0]} = \tilde{c}_i^{(0)},_0 \cdot H_{W,W}$$

$$\mathcal{D}_i^{(0)}|_{[0\ .\ .\ .\ 0]} = (x_{0,0} - \tilde{x}_i^{(0)},_0|_{[0\ .\ .\ .\ 0]})^2 \tag{21}$$

Index $i^{(0)}=0,1$ at this position represents the two different possible coordinates for lower (−) and upper (+) neighbor according to the pre-selection in the apple-peeling codebook in FIG. 8. The superposed convolution output and the partial (weighted) distortion are depicted in the square boxes for lower/upper neighbors. From tree layer to tree layer and thus vector coordinate (l-1) to vector coordinate l, the tree has branches to lower (−) and upper (+) neighbor. For each branch the superposed convolution output vectors and partial (weighted) distortions are updated according to $$\tilde{x}_i^{(l)}|_{[0\ .\ .\ .\ l]} = \tilde{x}_i^{(l-1)}|_{[0\ .\ .\ .\ (l-1)]} + \tilde{c}_i^{(l)},_l \cdot H_{W,W}$$

$$\mathcal{D}_i^{(l)}|_{[0\ .\ .\ .\ l]} = \mathcal{D}_i^{(l-1)}|_{[0\ .\ .\ .\ (l-1)]} + (x_{0,1} - \tilde{x}_i^{(l)},_l|_{[0\ .\ .\ .\ l]})^2 \tag{22}$$

In FIG. 8 at the tree layer for $\tilde{\phi}_1$, index $i^{(l=1)}=0\ .\ .\ .\ 3$ represents the index for the four possible combinations of $\tilde{\phi}_0$ and $\tilde{\phi}_1$. The index $i^{(l-1)}$ required for Equation (22) is determined by the backward reference to upper tree layers.

The described principle enables a very efficient computation of the (weighted) distortion for all $2^{(L_V-1)}$ pre-selected code vectors compared to an approach where all possible pre-selected code vectors are determined and processed by means of convolution. If the (weighted) distortion has been determined for all pre-selected centroids, the index of the vector with the minimal (weighted) distortion can be found.

3.2 Complexity Reduction based on Candidate-Exclusion (CE)

Figure 9:
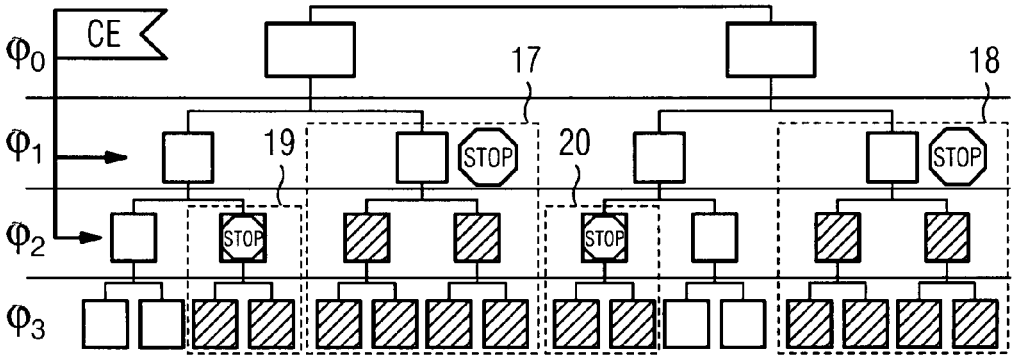
FIG. 9 the principle of candidate exclusion.

The principle of candidate-exclusion can be used in parallel to the pre-selection. This principle leads to a loss in quantisation SNR. However, even if the parameters for the candidate-exclusion are setup to introduce only a very small decrease in quantisation SNR still an immense reduction of computational complexity can be achieved. For the explanation of the principle, the binary code construction tree in FIG. 9 for dimension $L_V=5$ is considered. During the pre-selection, candidate-exclusion positions are defined such that each vector is separated into sub vectors. After the pre-selection according to the length of each sub vector a candidate-exclusion is accomplished, in FIG. 9 shown at the position where four candidates have been determined in the pre-selection for $\tilde{\phi}_l$. Based on the partial distortion measures $\mathcal{D}_i^{(l)}|0\ .\ .\ .\ 1$ determined for the four candidates $i^{(l)}$ at this point, the two candidates with the highest partial distortion are excluded from the search tree, indicated by the STOP-sign. An immense reduction of the number of computations can be achieved as with the exclusion at this position, a complete sub tree 17, 18, 19, 20 will be excluded. In FIG. 9, the excluded sub trees 17 to 20 are shown as boxes with the light gray background and the diagonal fill pattern. Multiple exclusion positions can be defined for the complete code vector length, in the example, an additional CE takes place for $\tilde{\phi}_2$.

4. Results of the Specific Vector Quantisation

The proposed codec principle is the basis for a low delay (around 8 ms) audio codec, realized in floating point arithmetic. Due to the codecs independence of a source model, it is suitable for a variety of applications specifying different target bit rates, audio quality and computational complexity. In order to rate the codecs achievable quality, it has been compared to the G.722 audio codec at 48 kbit/sec (mode 3) in terms of achievable quality for speech. The proposed codec has been parameterized for a sample rate of 16 kHz at a bit rate of 48 kbit/sec (2.8 bit per sample ($L_V=11$) plus transmission of N=10 LP parameters within 30 bits). Speech data of 100 seconds was processed by both codecs and the result rated with the wideband PESQ measure. The new codec outperforms the G.722 codec by 0.22 MOS (G.722 (mode 3): 3.61 MOS; proposed codec: 3.83 MOS). The complexity of the encoder has been estimated as 20-25 WMOPS using a weighted instruction set similar to the fixed point ETSI instruction set. The decoders complexity has been estimated as 1-2 WMOPS. Targeting lower bit rates, the new codec principle can be used at around 41 kbit/s to achieve a quality comparable to that of the G.722 (mode 3). The proposed codec provides a reasonable audio quality even at lower bit rates, e.g. at 35 kbit/sec.

A new low delay audio coding scheme is presented that is based on Linear Predictive coding as known from CELP, applying a spherical codebook construction principle named apple-peeling algorithm. This principle can be combined with an efficient vector search procedure in the encoder. Noise shaping is used to mask the residual coding noise for improved perceptual audio quality. The proposed codec can be adapted to a variety of applications demanding compression at a moderate bit rate and low latency. It has been compared to the G.722 audio codec, both at 48 kbit/sec, and outperforms it in terms of achievable quality. Due to the high scalability of the codec principle, higher compression at bit rates significantly below 48 kbit/sec is possible.

5. Efficient Codebook for the Scelp Low Delay Audio Codec 5.1 Spherical Coding Tree for Decoding For an efficient spherical decoding procedure it is proposed to employ a spherical coding tree in this contribution. In the context of the decoding process for the spherical vector quantisation the incoming vector index $i_Q$ is decomposed into index $i_R$ and index $i_{sp}$ with respect to equation (8). The reconstruction of the radius $\tilde{R}$ requires to read out an amplitude from a coding table due to scalar logarithmic quantisation. For the decoding of the shape part of the excitation vector, $$\tilde{c}=[\tilde{c}_0 \ldots \tilde{c}_{(L_V-1)}],$$

the sphere index $i_{sp}$ must be transformed into a code vector in cartesian coordinates. For this transformation the spherical coding tree is employed. The example for the 3-dimensional sphere 21 in FIG. 10 demonstrates the correspondence of the spherical code vectors on the unit sphere surface with the proposed spherical coding tree 22.

Figure 10:
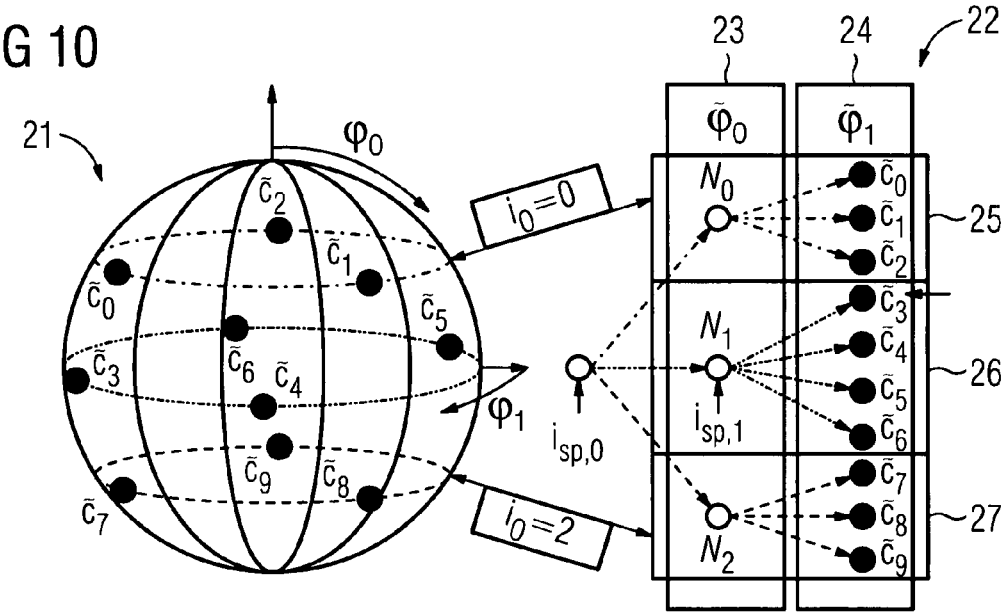
FIG. 10 the correspondence between code vectors and a coding tree.

The coding tree 22 on the right side of the FIG. 10 contains branches, marked as non-filled bullets, and leafs, marked as black colored bullets. One layer 23 of the tree corresponds to the angle $\tilde{\phi}_0$, the other layer 24 to angle $\tilde{\phi}_l$. The depicted coding tree contains three subtrees, marked as horizontal boxes 25, 26, 27 in different gray colors. Considering the code construction, each subtree represents one of the circles of latitude on the sphere surface, marked with the dash-dotted, the dash-dot-dotted, and the dashed line. On the layer for angle $\tilde{\phi}_0$, each subtree corresponds to the choice of index $i_0$ for the quantization reconstruction level of angle $\tilde{\phi}_{0,i0}$. On the tree layer for angle $\tilde{\phi}_1$ each coding tree leaf corresponds to the choice of index $i_l$ for the quantization reconstruction level of, $\tilde{\phi}_{l,il}(\tilde{\phi}_{0,i0})$. With each tuple of $[i_0,i_l]$ the angle quantization levels for $\tilde{\phi}_0$ and $\tilde{\phi}_l$ required to find the code vector $\tilde{c}$ are determined. Therefore each leaf corresponds to one of the centroids on the surface of the unit sphere, $\bar{c}_{i_{sp}}=[\bar{c}_{i_{sp},0}\,\bar{c}_{i_{sp},1}\,\bar{c}_{i_{sp},2}]$ with the index in FIG. 10. For decoding, the index $i_{sp}$ must be transformed into the coordinates of the spherical centroid vector. This transformation employs the spherical coding tree 22: The tree is entered at the coding tree root position as shown in the Figure with incoming index $i_{sp,0}=i_{sp}$. At the tree layer 23 for angle $\bar{\phi}_0$ a decision must be made to identify the subtree to which the desired centroid belongs to find the angle index $i_0$. Each subtree corresponds to an index interval, in the example either the index interval $i_{sp}|_{i_0=0}=0, 1, 2$, $i_{sp}|_{i_0=1}=3, 4, 5, 6$, or $i_{sp}|_{i_0=2}=7, 8, 9$. The determination of the right subtree for incoming index $i_{sp}$ on the tree layer corresponding to angle $\tilde{\phi}_0$ requires that the number of centroids in each subtree, $N_0$, $N_1$, $N_2$ in FIG. 10, is known. With the code construction parameter $N_{sp}$, these numbers can be determined by the construction of all subtrees. The index $i_0$ is found as $$i_0 = \begin{cases} 0 & \text{for } 0 \le i_{sp,0} < N_0 \\ 1 & \text{for } N_0 \le i_{sp,0} < (N_0 + N_1) \\ 2 & \text{for } (N_0 + N_1) \le i_{sp,0} < (N_0 + N_1 + N_2) \end{cases} \tag{23}$$

With index $i_0$ the first code vector reconstruction angle $\tilde{\phi}_{0,io}$ and hence also the first cartesian coordinate, $\bar{c}_{i_{sp},0}=\cos(\tilde{\phi}_{0,i_0})$, can be determined. In the example in FIG. 10, for $i_{sp}=3$, the middle subtree, $i_0=1$, has been found to correspond to the right index interval.

For the tree layer corresponding to $\tilde{\phi}_l$ the index $i_{sp,0}$ must be modified with respect to the found index interval according to the following equation:

$$i_{sp,1} = i_{sp,0} - \sum_{i=0}^{(i_0-1)} N_i. \tag{24}$$

As the angle $\tilde{\phi}_l$ is the final angle, the modified index corresponds to the index $i_l=i_{sp,l}$. With the knowledge of all code vector reconstruction angles in polar coordinates, the code vector $\tilde{c}_{isp}$ is determined as $$\bar{c}_{i_{sp},0}=\cos(\bar{\phi}_{0,i_0})$$

$$\bar{c}_{i_{sp},1}=\sin(\bar{\phi}_{0,i_0})\cdot\cos(\bar{\phi}_{1,i_1})$$

$$\bar{c}_{i_{sp},2}=\sin(\bar{\phi}_{0,i_0})\cdot\sin(\bar{\phi}_{1,i_1}) \tag{25}$$

For a higher dimension $L_V>3$, the index modification in (24) must be determined successively from one tree layer to the next.

The subtree construction and the index interval determination must be executed on each tree layer for code vector decoding. The computational complexity related to the construction of all subtrees on all tree layers is very high and increases exponentially with the increase of the sphere dimension $L_V>3$. In addition, the trigonometric functions used in (25) in general are very expensive in terms of computational complexity. In order to reduce the computational complexity the coding tree with the number of centroids in all subtrees is determined in advance and stored in ROM. In addition, also the trigonometric function values will be stored in lookup tables, as explained in the following section.

Even though shown only for the decoding, the principle of the coding tree and the trigonometric lookup tables can be combined with the Pre-Search and the Candidate-Exclusion methodology described above very efficiently to reduce also the encoder complexity.

5.2 Efficient Storage of the Codebook

Under consideration of the properties of the apple-peeling code construction rule the coding tree and the trigonometric lookup tables can be stored in ROM in a very compact way:

A. Storage of the Coding Tree

Figure 11:
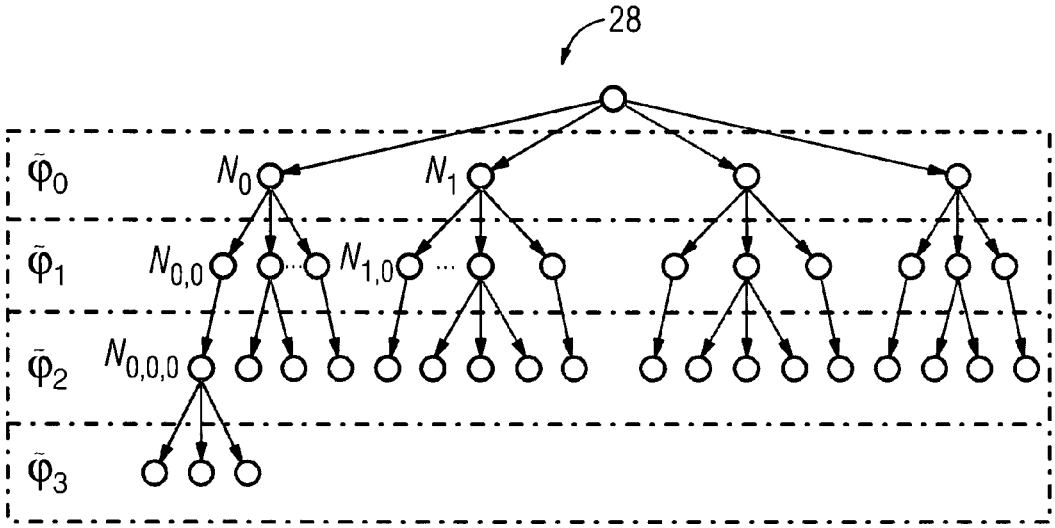
FIG. 11 a compact realization of the coding tree.

For the explanation of the storage of the coding tree, the example depicted in FIG. 11 is considered.

Compared to FIG. 10 the coding tree has 4 tree layers and is suited for a sphere of higher dimension $L_V=5$. The number of nodes stored for each branch are denoted as $N_{i0}$ for the first layer, $N_{i0,i1}$ for the next layer and so on. The leafs of the tree are only depicted for the very first subtree, marked as filled gray bullets on the tree layer for $\tilde{\phi}_3$. The leaf layer of the tree is not required for decoding and therefore not stored in memory. Considering the principle of the sphere construction according to the apple-peeling principle, on each remaining tree layer for $\tilde{\phi}_l$ with l=0, 1 ,2 the range of the respective angle, $0 \leqq \tilde{\phi}_l \leqq \pi$, is separated into an even or odd number of angle intervals by placing the centroids on sub spheres according to (4) and (7). The result is that the coding tree and all available subtrees are symmetric as shown in FIG. 11. It is hence only necessary to store half of the coding tree 28 and also only half of all subtrees. In FIG. 10 that part of the coding tree that must be stored in ROM is printed in black color while the gray part of the coding tree is not stored. Especially for higher dimension only a very small part of the overall coding tree must be stored in memory.

B. Storage of the Trigonometric Functions Table

Due to the high computational complexity for trigonometric functions, the storage of all function values in lookup tables is very efficient. These tables in general are very large to cover the complete span of angles with a reasonable accuracy. Considering the apple-peeling code construction, only a very limited number of discrete trigonometric function values are required as shown in the following: Considering the code vectors in polar coordinates, from one angle to the next the number of angle quantization levels according to equation (6) is constant or decreases. The number of quantization levels for $\tilde{\phi}_0$ is identical to the code construction parameter $N_{sp}$. With this a limit for the number of angle quantization levels $N_{sp,l}$ for each angle $\tilde{\phi}_l=0 \ldots (L_V-2)$ can be found:

$$N_{sp,l}(\tilde{\varphi}_{0,i_0} \cdots \tilde{\varphi}_{0,i_{l-1}}) \leq \begin{cases} N_{sp} & 0 \leq l < (L_V-2) \\ 2N_{sp} & l = (L_V-2) \end{cases} \quad (26)$$

The special case for the last angle is due to the range of $0 \leqq \tilde{\phi}_{L_V-2} \leqq 2\pi$. Consequently, the number of available values for the quantized angles required for code vector reconstruction according to (4) and (7) is limited to $$\tilde{\varphi}_l \in \begin{cases} \left(j+\frac{1}{2}\right)\cdot\frac{\pi}{N_{sp,l}} & \text{for } l < (L_V-2) \\ \left(j+\frac{1}{2}\right)\cdot\frac{2\pi}{N_{sp,l}} & \text{for } l = (L_V-2) \end{cases} \quad (27)$$

with $j=0 \ldots (N_{sp,l}-1)$ as the index for the angle quantization level. For the reconstruction of the vector $\tilde{c}$ in cartesian coordinates according to (25) only those trigonometric function values are stored in the lookup table that may occur during signal compression/decompression according to (27). With the limit shown in (26) this number in practice is very small. The size of the lookup table is furthermore decreased by considering the symmetry properties of the cos and the sin function in the range of $0 \leqq \tilde{\phi}_l \leqq \pi$ and $0 \leqq \tilde{\phi}_{L_V-2} \leqq 2\pi$ respectively.

5.3 Results Relating to Complexity Reduction

The described principles for an efficient spherical vector quantization are used in the SCELP audio codec to achieve the estimated computational complexity of 20-25 WMOPS as described in Sections 1 to 4. Encoding without the proposed methods is prohibitive considering a realistic real-time realization of the SCELP codec on a state-of-the-art General Purpose PC. The complexity estimation in the referenced contribution has been determined for a configuration of the SCELP codec for a vector length of $L_V=11$ with an average bit rate of $r_0=2.8$ bit per sample plus additional bit rate for the transmission of the linear prediction coefficients. In the context of this configuration a data rate of approximately 48 kbit/sec for audio compression at a sample rate of 16 kHz could be achieved. Considering the required size of ROM, the new codebook is compared to an approach in which a lookup table is used to map each incoming spherical index to a centroid code vector. The iterative spherical code design procedure results in $N_{sp}=13$. The number of centroids on the surface of the unit sphere is determined as $M_{sp}=18806940$ while the number of quantization intervals for the radius is $M_R=39$. The codebook for the quantization of the radius is the same for the compared approaches and therefore not considered. In the approach with the lookup table $M_{sp}$ code vectors of length $L_V=11$ must be stored in ROM, each sample in 16 bit format. The required ROM size would be $$M_{ROM,lookup}=18806940\cdot 16\text{ Bit}\cdot 11=394.6\ M\text{Byte}. \quad (28)$$

For the storage of the coding tree as proposed in this document, only 290 KByte memory is required. With a maximum of $N_{sp,l}=13$ angle quantization levels for the range of $0 \ldots \pi$ and $N_{sp,(L_V-2)}=26$ levels for the range of $0 \ldots \pi$, the trigonometric function values for code vector reconstruction are stored in 2 KByte ROM in addition to achieve a resolution of 32 Bit for the reconstructed code vectors. Comparing the two approaches the required ROM size can be reduced with the proposed principles by a factor of $$\frac{M_{ROM,lookup}}{M_{ROM,tree}} \approx 1390. \quad (29)$$

Thus, an auxiliary codebook has been proposed to reduce the computational complexity of the spherical code as applied in the SCELP. This codebook not only reduces the computational complexity of encoder and decoder simultaneously, it should be used to achieve a realistic performance of the SCELP codec. The codebook is based on a coding tree representation of the apple-peeling code construction principle and a lookup table for trigonometric function values for the transformation of a codeword into a code vector in Cartesian coordinates. Considering the storage of this codebook in ROM, the required memory can be downscaled in the order of magnitudes with the new approach compared to an approach that stores all code vectors in one table as often used for trained codebooks.

The invention claimed is:

1. A method for encoding audio data, comprising:

providing an audio input vector to be encoded;

preselecting a group of code vectors of an spherical codebook comprising a number of code vectors;

determining a respective partial distortion measurement associated with the code vectors in the preselected group of code vectors;

excluding a number of the code vectors in the preselected group of code vectors, wherein the excluding is based on a value of the determined partial distortion measurement;

as a result of the preselecting and excluding, defining a reduced group of code vectors relative to the number of code vectors comprising the spherical codebook;

searching in the reduced group of code vectors to find a code vector having a sufficiently low quantisation error with respect to the input vector to mask quantization noise; and encoding the input vector with the code vector found in the searching of the reduced group of code vectors.

2. The method as claimed in claim 1, wherein the preselected group of code vectors of a codebook are selected code vectors in a vicinity of the input vector.

3. The method as claimed in claim 1, wherein partial distortions are calculated for quantisation values of one dimension of the preselected code vectors, wherein values of the partial distortion of the excluded code vectors are higher than the partial distortion of other code vectors of the group of preselected code vectors.

4. A method for encoding audio data, comprising:
providing an audio input vector to be encoded;
preselecting a group of code vectors of a codebook; and
encoding the input vector with a code vector of the group of code vectors having a lowest quantisation error within the group of preselected code vectors with respect to the input vector,
wherein the code vectors are obtained by a apple-peeling-method, wherein each code vector is represented as a branch of a code tree linked with a table of trigonometric function values, wherein the code tree and the table are stored in a memory so that each code vector used for encoding the audio data is reconstructable based on the code tree and the table.

5. The method as claimed in claim 4, wherein the encoding is based upon a linear prediction combined with vector quantisation based on a gain-shape vector codebook.

6. The method as claimed in claim 5, wherein the input vector is located between two quantisation values of each dimension of the code vector space and each code vector of the group of preselected vectors has a coordinate corresponding to one of the two quantisation values.

7. The method as claimed in claim 6, wherein the quantisation error of each preselected code vector of a pregiven quantisation value of one dimension is calculated on the basis of the partial distortion of said quantisation value, wherein the partial distortion is calculated once for all code vectors of the pregiven quantisation value.

8. A method to communicate audio data, comprising:
generating the audio data in a first audio device;
encoding the audio data in the first audio device by:
providing an audio input vector to be encoded,
preselecting a group of code vectors of an spherical codebook comprising a number of code vectors,
determining a respective partial distortion measurement associated with the code vectors in the preselected group of code vectors;
excluding a number of the code vectors in the preselected group of code vectors, wherein the excluding is based on a value of the determined partial distortion measurement;
as a result of the preselecting and excluding, forming a reduced group of code vectors relative to the number of code vectors of the spherical codebook;
searching in the reduced group of code vectors to find a code vector having a sufficiently low quantisation error with respect to the input vector to mask quantization noise;
encoding the input vector with the code vector found in the searching of the reduced group of code vectors;
transmitting the encoded audio data from the first audio device to a second audio device; and
decoding the encoded audio data in the second audio device.

9. The method as claimed in claim 8, wherein an index unambiguously representing a code vector is assigned to the code vector selected for encoding, wherein the index is transmitted from the first audio device to the second audio device and the second audio device uses a code tree and table for reconstructing the code vector and decodes the transmitted data with a reconstructed code vector.

10. A method to communicate audio data, comprising:
generating the audio data in a first audio device;
encoding the audio data in the first audio device by:
providing an audio input vector to be encoded,
preselecting a group of code vectors of a codebook, and
encoding the input vector with a code vector of the group of code vectors having a lowest quantisation error within the group of preselected code vectors with respect to the input vector;
transmitting the encoded audio data from the first audio device to a second audio device; and
decoding the encoded audio data in the second audio device, wherein an index unambiguously representing a code vector is assigned to the code vector selected for encoding, wherein the index is transmitted from the first audio device to the second audio device and the second audio device uses a code tree and table for reconstructing the code vector and decodes the transmitted data with a reconstructed code vector, wherein the code vectors are obtained by a apple-peeling-method, wherein each code vector is represented as a branch of the code tree linked with a table of trigonometric function values, wherein the code tree and the table are stored in a memory so that each code vector used for encoding the audio data is reconstructable based on the code tree and the table.

11. A device for encoding audio data, comprising:
an audio vector device to provide an audio input vector to be encoded;
a preselecting device to preselect a group of code vectors of an spherical codebook comprising a number of code vectors by selecting code vectors received from the audio vector device, the preselecting device configured to determine a respective partial distortion measurement associated with the code vectors in the preselected group of code vectors;
a code vector excluding-device configured to exclude a number of the code vectors in the preselected group of code vectors based on a value of the determined partial distortion measurement, wherein the preselecting device and excluding-device are configured to define a reduced group of code vectors relative to the number of code vectors of the spherical codebook;
a code vector searching-device configured to search in the reduced group of code vectors to find a code vector having a sufficiently low quantisation error with respect to the input vector to mask quantization noise; and
an encoding device configured to encode the input vector found by the code vector searching-device in the reduced group of code vectors.

12. The device as claimed in claim 11, wherein the encoding is based upon a linear prediction combined with vector quantisation based on a gain-shape vector codebook.

13. The device as claimed in claim 12, wherein the selected code vectors are in a vicinity of the input vector received from the audio vector device.

14. The device as claimed in claim 11, wherein the input vector is located between two quantisation values of each dimension of the code vector space and the preselecting device is preselecting the group of code vectors so that each code vector of the group of preselected code vectors has a coordinate corresponding to one of the two quantisation values.

15. The device as claimed in claim 14, wherein the quantisation error for each preselected code vector of a given quantisation value of one dimension is calculated based on the preselecting means based upon the partial distortion of said quantisation value.

16. The device as claimed in claim 15, wherein the partial distortion is calculated once for all code vectors of the pregiven quantisation value.

17. The device as claimed in claim 11, wherein the partial distortions are calculated by the preselecting device for quantisation values of one dimension of the preselected code vectors, and wherein values of the partial distortion of the excluded code vectors are higher than the partial distortion of other code vectors of the group of preselected code vectors.

18. The device as claimed in claim 11, wherein the device is integrated in an audiosystem, wherein the audiosystem has a first audio device and a second audio device, wherein the first audio device has the encoding device for audio data and a transmitting device for transmitting the encoded audio data to the second audio device, wherein the second audio device has a decoding device for decoding the encoded audio data received from the first audio device.

19. The device as claimed in claim 18, wherein an index unambiguously representing a code vector is assigned to the code vector selected for encoding by the device, wherein the index is transmitted from the first audio device to the second audio device and the second audio device uses the same code tree and table for reconstructing the code vector and decodes the transmitted data with the reconstructed code vector.

20. A device for encoding audio data, comprising:

an audio vector device to provide an audio input vector to be encoded;

a preselecting device to preselect a group of code vectors of a codebook by selecting code vectors received from the audio vector device; and an encoding device connected to the preselecting device for encoding the input vector from the audio vector device with a code vector of the group of code vectors having the lowest quantisation error within the group of preselected code vectors with respect to the input vector, wherein the code vectors of the codebook for the preselecting device are given by an apple-peeling-method, wherein each code vector is represented as a branch of a code tree linked with a table of trigonometric function values, wherein the code tree and the table are stored in a memory so that each code vector used for encoding the audio data is reconstructable on the basis of the code tree and the table.

* * * * *